US006209228B1

(12) United States Patent
Yang

(10) Patent No.: US 6,209,228 B1
(45) Date of Patent: Apr. 3, 2001

(54) SHOE PAD ASSEMBLY

(76) Inventor: Shi-Hong Yang, 58 Ma Yuan West St., Taichung (TW)

( * ) Notice: Subject to any disclaimer, the term of this patent is extended or adjusted under 35 U.S.C. 154(b) by 0 days.

(21) Appl. No.: 09/436,953

(22) Filed: Nov. 6, 1999

(51) Int. Cl.[7] ..... A43B 13/38
(52) U.S. Cl. ..... 36/44; 36/71; 36/3 R
(58) Field of Search ..... 36/43, 44, 30 R, 36/28, 3 R, 3 B, 71

(56) References Cited

U.S. PATENT DOCUMENTS 4,054,706 * 10/1977 Shapiro ..... 428/213
4,099,342 * 7/1978 Singh ..... 36/44
4,186,499 * 2/1980 Massok, Jr. et al. ..... 36/44
4,729,179 * 3/1988 Quist, Jr. ..... 36/44
5,584,130 * 12/1996 Perron ..... 36/44
5,614,303 * 3/1997 Baigas, Jr. ..... 442/247
5,955,172 * 9/1999 Hurten ..... 428/116
6,082,025 * 7/2000 Bonk et al. ..... 36/29

* cited by examiner

*Primary Examiner*—Paul T. Sewell
*Assistant Examiner*—Jila Mohandesi

(57) ABSTRACT

A shoe pad assembly has a first layer, a second layer, a third layer, and an elastic base layer. The first layer is an air permeable fabric. The second layer has a gauze dipping in a solution containing activated carbon, alum, resin and ceramic powders producing far-infrared to form two web-shaped films on the gauze to become an air permeable layer. The third layer is a water absorbing polyethylene terephthalate non-woven fabric layer.

2 Claims, 2 Drawing Sheets

SHOE PAD ASSEMBLY

BACKGROUND OF THE INVENTION

The present invention relates to a shoe pad assembly. More particularly, the present invention relates to a shoe pad assembly which is used as an insole.

A conventional shoe pad is made in one piece. In general, the conventional shoe pad has poor air permeable effect and poor water absorbing effect.

SUMMARY OF THE INVENTION

An object of the present invention is to provide a shoe pad assembly which has a polyethylene terephthalate non-woven fabric layer to absorb water effectively.

Another object of the present invention is to provide a shoe pad assembly which has a gauze dipping in a solution containing activated carbon, alum, resin and ceramic powders producing far-infrared in order to form two web-shaped films on the gauze to become an air permeable layer.

Accordingly, a shoe pad assembly comprises a first layer, a second layer, a third layer, and an elastic base layer. The third layer is disposed on the elastic base layer. The second layer is disposed on the third layer. The first layer is disposed on the second layer. The first layer is an air permeable fabric. The second layer has two web-shaped films and a gauze disposed between the web-shaped films. The third layer is a water absorbing polyethylene terephthalate non-woven fabric layer.

DETAILED DESCRIPTION OF THE INVENTION

Figure 1:
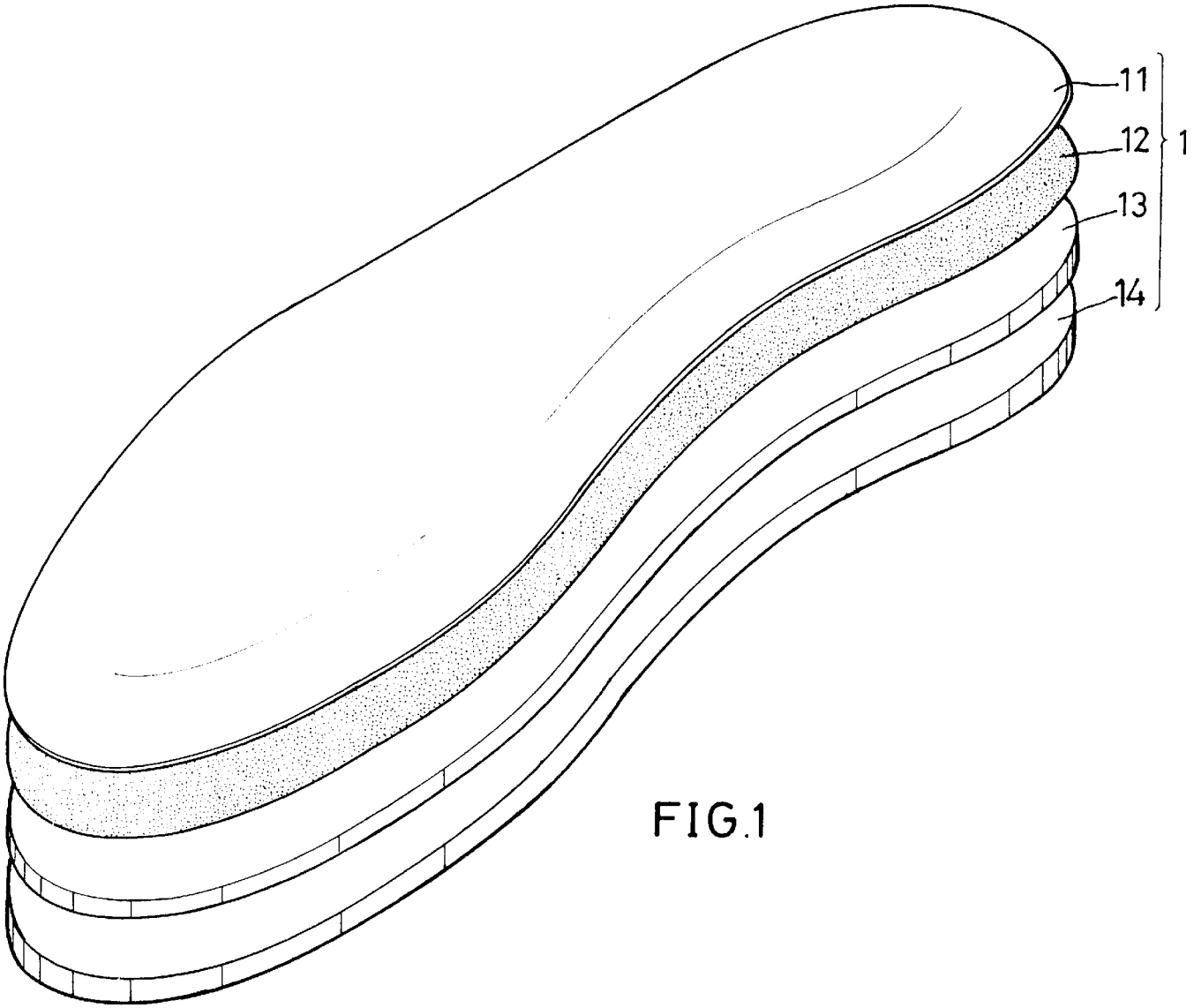
FIG. 1 is a perspective exploded view of a shoe pad assembly of a preferred embodiment in accordance with the present invention.
Figure 2:
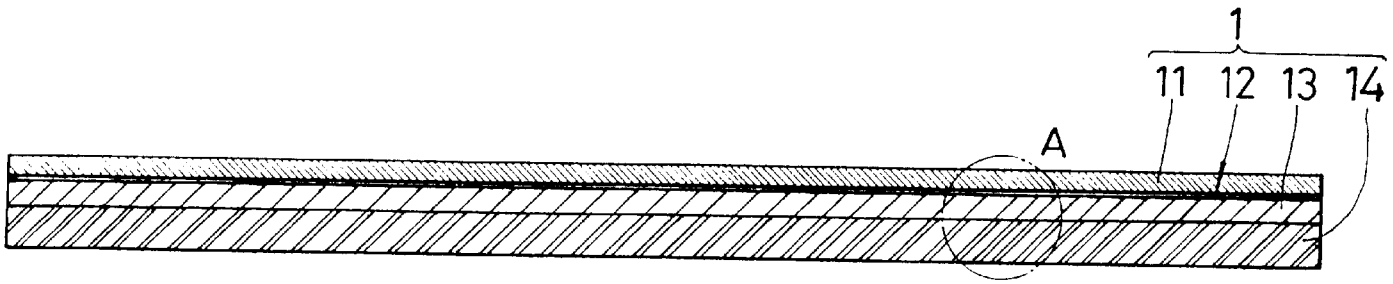
FIG. 2 is a sectional assembly view of a shoe pad assembly of a preferred embodiment in accordance with the present invention.
Figure 3:
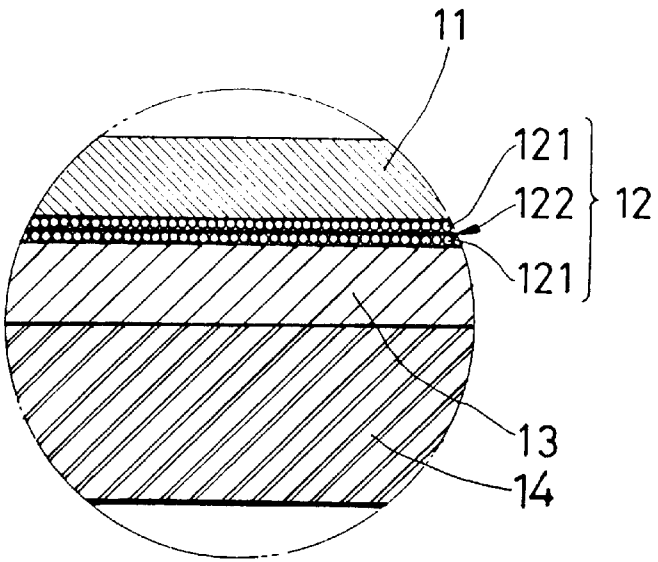
FIG. 3 is a partially enlarged view of FIG. 2.

Referring to FIGS. 1 to 3, a shoe pad assembly 1 comprises a first layer 11, a second layer 12, a third layer 13, and an elastic base layer 14.

The third layer 13 is disposed on the elastic base layer 14.

The second layer 12 is disposed on the third layer 13.

The first layer 11 is disposed on the second layer 12.

The first layer 11 is an air permeable fabric.

The second layer 12 has a gauze 122 dipping in a solution containing activated carbon, alum, resin and ceramic powders producing far-infrared in order to form two web-shaped (non-woven) films 121 on the gauze 122 to become an air permeable layer.

The third layer 13 is a water absorbing polyethylene terephthalate (PET) non-woven fabric layer.

When the gauze 122 is dipped in a solution containing activated carbon, alum, resin and ceramic powders, the activated carbon, alum, resin and ceramic powders are adhered on the gauze 122. After the gauze 122, the activated carbon, the alum, the resin and the ceramic powders are dried, two web-shaped (non-woven) films 121 are formed on the gauze 122 so that the gauze 122 and the web-shaped (non-woven) films 121 become an air permeable layer.

The first layer 11, the second layer 12, the third layer 13, and the elastic base layer 14 are preheated in a mold and impacted in the mold to form a product.

The present invention is not limited to the above embodiment but various modification thereof may be made. Furthermore, various changes in form and detail may be made without departing from the scope of the present invention.

I claim:

1. A shoe pad assembly comprises:

a first layer, a second layer, a third layer, and an elastic base layer, the third layer disposed on the elastic base layer, the second layer disposed on the third layer, the first layer disposed on the second layer, the first layer being an air permeable fabric, the second layer having two web-shaped films and a gauze disposed between the web-shaped films, and the third layer being a water absorbing polyethylene terephthalate non-woven fabric layer.

2. The shoe pad assembly as claimed in claim 1, wherein the gauze is dipped in a solution containing activated carbon, alum, resin and ceramic powders, the activated carbon, alum, resin and ceramic powders are adhered and dried on the gauze to form the web-shaped films.

* * * * *